US011084639B2

(12) United States Patent
Ball

(10) Patent No.: US 11,084,639 B2
(45) Date of Patent: Aug. 10, 2021

(54) CARTON AND CARTON BLANK

(71) Applicant: WestRock Packaging Systems, LLC, Atlanta, GA (US)

(72) Inventor: Nathaniel B. Ball, Richmond, VA (US)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 0 days.

(21) Appl. No.: 16/648,420

(22) PCT Filed: Sep. 13, 2018

(86) PCT No.: PCT/US2018/050812

§ 371 (c)(1),
(2) Date: Mar. 18, 2020

(87) PCT Pub. No.: WO2019/055605

PCT Pub. Date: Mar. 21, 2019

(65) Prior Publication Data

US 2020/0270040 A1 Aug. 27, 2020

Related U.S. Application Data

(60) Provisional application No. 62/559,904, filed on Sep. 18, 2017.

(51) Int. Cl.
*B65D 71/36* (2006.01)

(52) U.S. Cl.
CPC ..... *B65D 71/36* (2013.01); *B65D 2571/0053* (2013.01); *B65D 2571/0058* (2013.01); *B65D 2571/0066* (2013.01); *B65D 2571/00141* (2013.01); *B65D 2571/00469* (2013.01); *B65D 2571/00728* (2013.01)

(58) Field of Classification Search
CPC ..... B65D 5/02; B65D 5/0227; B65D 5/42; B65D 5/4208; B65D 5/4266; B65D 5/44; B65D 5/443; B65D 71/16; B65D 71/36; B65D 2571/00141; B65D 2571/469;
(Continued)

(56) References Cited

U.S. PATENT DOCUMENTS 4,128,169 A 12/1978 Arneson
4,728,026 A 3/1988 Schuster
(Continued)

FOREIGN PATENT DOCUMENTS

JP U11986134916 8/1986
WO WO 2016-168557 A1 10/2016

*Primary Examiner* — Bryon P Gehman
(74) *Attorney, Agent, or Firm* — Brian J. Goldberg; Neil G. Cohen

(57) ABSTRACT

A carton (90) for packaging one or more articles. The carton comprises a plurality of wall forming a tubular structure. The plurality of walls include a top wall (12), first side wall (14) hinged to the top wall by a first hinged connection (13) and a second side wall (18) hinged to the top wall by a second hinged connection. The carton comprises a handle structure comprising a handle aperture (A2) struck at least in part from the top wall and defining in part a handle strap (40*a*). The handle aperture comprises a first edge (E1) defining in part a grip portion of the handle strap and providing a load-bearing edge; and a second edge (E2) opposing the first edge, the second edge being a non-load-bearing edge. A reinforcing member (S) reinforces the load-bearing edge of the handle aperture.

17 Claims, 5 Drawing Sheets

(58) Field of Classification Search
CPC ..... B65D 2571/53; B65D 2571/58; B65D 2571/66; B65D 2571/728
USPC ..... 206/141
See application file for complete search history.

(56) References Cited

U.S. PATENT DOCUMENTS

| | | | | |
|---|---|---|---|---|
| 4,875,586 | A | 10/1989 | Chaussadas | |
| 5,611,431 | A * | 3/1997 | Harris | B65D 71/16 206/153 |
| 9,126,716 | B2 | 9/2015 | Kohler et al. | |
| 2009/0236408 | A1 | 9/2009 | Spivey, Sr. | |
| 2013/0008940 | A1 * | 1/2013 | Schumaker | B65D 71/36 229/198.2 |
| 2016/0159516 | A1 | 6/2016 | Ball | |

* cited by examiner

CARTON AND CARTON BLANK

CROSS-REFERENCE TO RELATED APPLICATIONS

This application is a National Phase application of PCT Application PCT/US18/50812, filed Sep. 13, 2018, which claims the benefit of U.S. Provisional Patent Application No. 62/559,904, filed Sep. 18, 2017, which is incorporated herein by reference in its entirety.

TECHNICAL FIELD

The present invention relates to a carton and blank for forming the same more specifically, but not exclusively, to a carton comprising a handle structure for transportation of the carton.

BACKGROUND

In the field of packaging it is often required to provide consumers with a package comprising multiple primary product containers. Such multi-packs are desirable for shipping and distribution purposes and for the display of promotional information. For cost and environmental considerations, such cartons or carriers need to be formed from as little material as possible and cause as little wastage as possible in the materials from which they are formed. Another consideration is the strength of the packaging and its suitability for holding and transporting large weights of articles.

The present invention seeks to overcome or at least mitigate the problems of the prior art.

SUMMARY

According to a first aspect of the present disclosure there is provided a carton for packaging one or more articles, the carton comprising a plurality of walls forming a tubular structure, the plurality of walls including a top wall, first side wall hinged to the top wall by a first hinged connection and a second side wall hinged to the top wall by a second hinged connection, the carton comprising a handle structure comprising:

- a handle aperture struck at least in part from the top wall and defining in part a handle strap, the handle aperture comprising;
  - a first edge defining in part a grip portion of the handle strap and providing a load-bearing edge; and
  - a second edge opposing the first edge, the second edge being a non-load-bearing edge;
- a reinforcing member which reinforces the load-bearing edge of the handle aperture, and
- wherein the handle aperture extends across the first panel such that the second edge interrupts the hinged connection between the top wall and first side wall.

Optionally, the handle structure comprises:

- a second handle aperture struck at least in part from the top wall and defining in part the handle strap, the second handle aperture comprising;
  - a third edge defining in part a grip portion of the handle strap and providing a second load-bearing edge; and
  - a fourth edge opposing the third edge, the fourth edge being a second non-load-bearing edge;
- wherein the reinforcing member reinforces the second load-bearing edge, and

- wherein the second handle aperture extends across the top panel such that the second edge interrupts the hinged connection between the top wall and the second side wall.

According to a second aspect of the present disclosure there is provided a handle structure for a carton comprising;

- a first panel; and
- a second panel hingedly connected thereto by a hinged connection;
- wherein the handle structure comprises a handle aperture struck from the first panel and defining in part a carrying handle, the handle aperture comprising;
  - a first edge defining in part a grip portion of the carrying handle and providing a load-bearing edge; and
  - a second edge opposing the first edge, the second edge being a non-load-bearing edge;
- wherein the handle structure comprises a reinforcing member which reinforces the load-bearing edge, and
- wherein the second edge of the handle aperture extends across the first panel to interrupt the hinged connection between the first and second panels.

Optionally, the first panel and the reinforcing member define a multi-layer structure along the first edge.

Optionally, the second edge is an unreinforced structure.

Optionally, the second edge is a single-layer structure.

Optionally, the handle structure comprises a second handle aperture struck from the first panel and defining in part the carrying handle, the second handle aperture comprising;

- a third edge defining in part the grip portion of the carrying handle and providing a second load-bearing edge; and
- a fourth edge opposing the third edge, the fourth edge being a non-load-bearing edge;
- wherein the reinforcing member reinforces the second load-bearing edge, and
- wherein the second edge of the handle aperture extends across the first panel to interrupt a second hinged connection between the first panel and a third panel.

Optionally, the handle structure comprises a third panel secured in partial overlapping relationship with the first panel to form a composite wall panel of the carton, the third panel comprising a second handle aperture struck therefrom and defining in part the reinforcing member, the second handle aperture comprising;

- a third edge defining in part a grip portion of the carrying handle and providing a second load-bearing edge; and
- a fourth edge opposing the third edge, the fourth edge being a non-load-bearing edge;
- wherein the reinforcing member reinforces the second load-bearing edge, and
- wherein the second edge of the second handle aperture extends across the first panel to interrupt a hinged connection between the third panel and a fourth panel, the fourth panel opposing the second panel.

According to a third aspect of the present disclosure there is provided a carton for packaging one or more articles, the carton having handle structure comprising;

- a first panel; and
- a second panel hingedly connected thereto by a hinged connection;
- wherein the first panel comprises a handle aperture defining in part a handle strap, the handle aperture comprising;
  - a first edge defining in part a grip portion of the handle strap and providing a load-bearing edge; and a second edge opposing the first edge the second edge being a non-load-bearing edge;

wherein the handle structure comprises a reinforcing member which reinforces the load-bearing edge, and wherein the second edge of the handle aperture extends across the first panel to interrupt the hinged connection between the first and second panels.

According to a fourth aspect of the present disclosure there is provided a package comprising a carton and one or more articles, the carton comprising a plurality of panels for forming a tubular structure, the plurality of panels including;

a first panel;

a second panel hingedly connected thereto by a hinged connection; and a handle structure, the handle structure comprising a handle aperture struck from the first panel and defining in part a handle strap, the handle aperture comprising;

a first edge defining in part a grip portion of the handle strap and providing a load-bearing edge; and a second edge opposing the first edge the second edge being a non-load-bearing edge;

wherein the handle structure comprises a reinforcing member which reinforces the load-bearing edge, and the second edge of the handle aperture extends across the first panel to interrupt the hinged connection between the first and second panels.

Optionally, the handle aperture is shaped such that the second edge is disposed in close proximity to one or more of the article disposed with the carton so as to prevent or inhibit a user from engaging with the second edge.

Optionally, the handle aperture is shaped such that the second edge is disposed in close proximity to one or more of the article disposed with the carton so as to discourage a user from engaging with the second edge.

According to a fifth aspect of the present disclosure there is provided a blank for forming a carton, the blank comprising a plurality of panels for forming a tubular structure including a top wall panel and first side wall panel hinged to the top wall panel by a first hinged connection, the blank comprising a handle structure comprising:

a handle aperture struck at least in part from the top wall panel and defining in part a handle strap, the handle aperture comprising;

a first edge defining in part a grip portion of the handle strap and providing a load-bearing edge; and a second edge opposing the first edge, the second edge being a non-load-bearing edge;

a reinforcing member securable to the first top wall panel to reinforce the load-bearing edge of the handle aperture, and wherein the handle aperture extends across the first panel such that the second edge interrupts the hinged connection between the top wall panel and first side wall panel.

Optionally, the blank comprises a second side wall panel hinged to the top wall panel by a second hinged connection, wherein the handle structure comprises:

a second handle aperture struck at least in part from the top wall panel and defining in part the handle strap, the second handle aperture comprising;

a third edge defining in part a grip portion of the handle strap and providing a second load-bearing edge; and a fourth edge opposing the third edge, the fourth edge being a second non-load-bearing edge;

wherein the reinforcing member reinforces the second load-bearing edge, and wherein the second handle aperture extends across the top panel such that the second edge interrupts the hinged connection between the top wall and the second side wall.

Optionally, the blank comprises a second side wall panel hinged to a second top wall panel by a second hinged connection, wherein the handle structure comprises:

a second handle aperture struck at least in part from the second top wall panel, the second handle aperture comprising;

a third edge providing a second load-bearing edge; and a fourth edge opposing the third edge, the fourth edge being a second non-load-bearing edge;

wherein the second top wall panel comprises the reinforcing member which reinforces the first and second load-bearing edge in a setup carton, and wherein the second handle aperture extends across the second top panel such that the second edge interrupts the hinged connection between the second top wall and the second side wall panel.

According to a fifth aspect of the present disclosure there is provided a carton for packaging one or more articles comprising a plurality of panels for forming a tubular structure including a top panel, a first side wall panel, a second side wall panel and a base panel, the carton comprising a handle structure defined at least in the top panel, the handle structure comprising a handle strap, wherein the carton comprises a relief structure for controlling and directing deformation of at least one of the first and second side wall panels, the relief structure comprising a first fold line extending across at least a portion of said at least one of the first and second side wall panels, and a pair of divergently arranged fold line disposed on opposing sides of the first fold line, wherein a handle aperture interrupts a hinged connection between the top panel and said at least one of the first and second side wall panels, the handle aperture interrupts the hinged connection adjacent to the relief structure.

According to a sixth aspect of the present disclosure there is provided a blank for forming a carton, the blank comprising a plurality of panels for forming a tubular structure including a top panel, a first side wall panel, a second side wall panel and a base panel, the blank comprising a handle structure defined at least in the top panel, the handle structure comprising a handle strap, wherein the blank comprises a relief structure for controlling and directing deformation of at least one of the first and second side wall panels, the relief structure comprising a first fold line extending across at least a portion of said at least one of the first and second side wall panels, and a pair of divergently arranged fold line disposed on opposing sides of the first fold line, wherein a handle aperture interrupts a hinged connection between the top panel and said at least one of the first and second side wall panels, the handle aperture interrupts the hinged connection adjacent to the relief structure.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
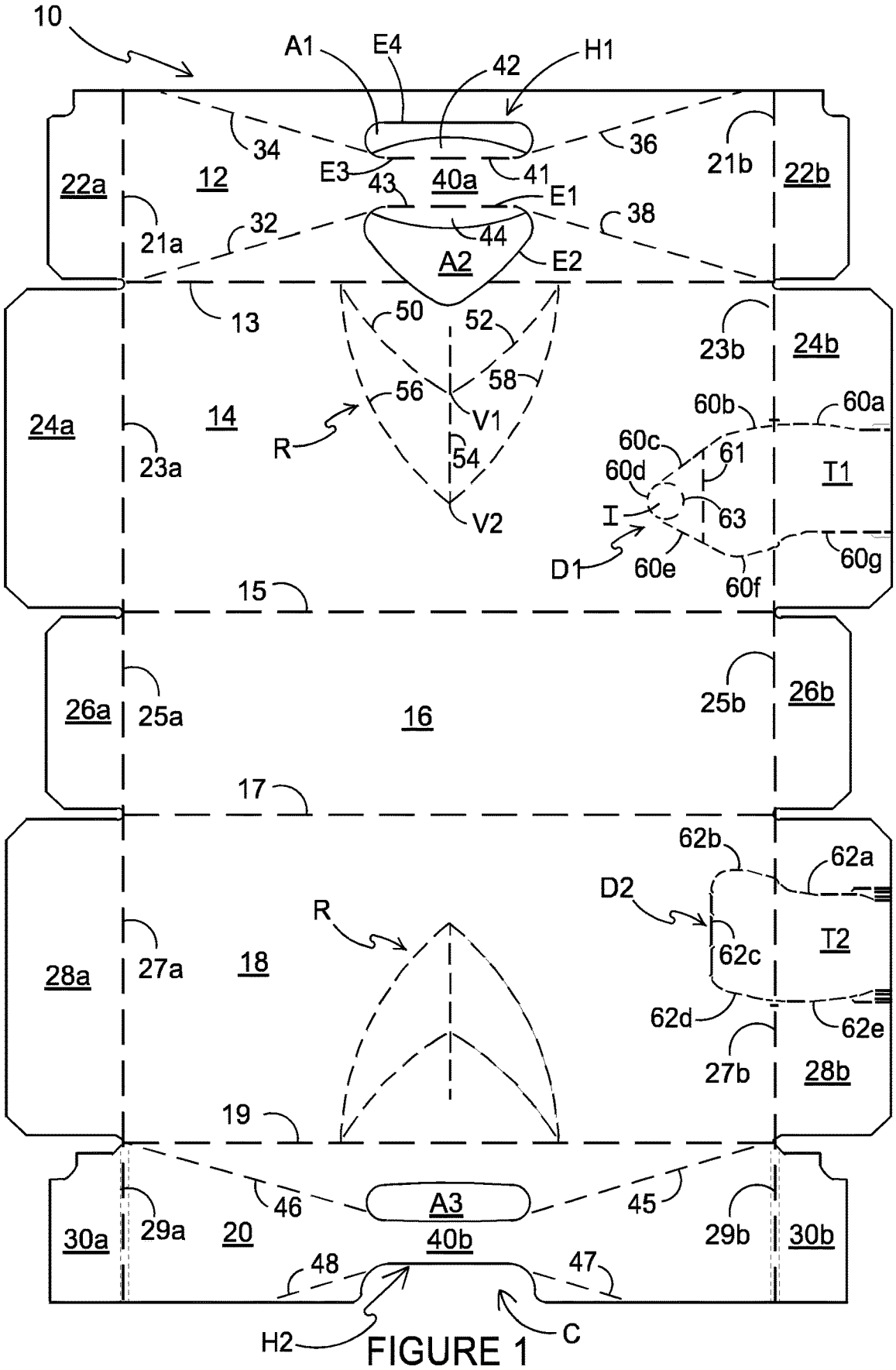
FIG. 1 is a plan view from above of a blank for forming a carton according to a first embodiment of the invention.
Figure 2:
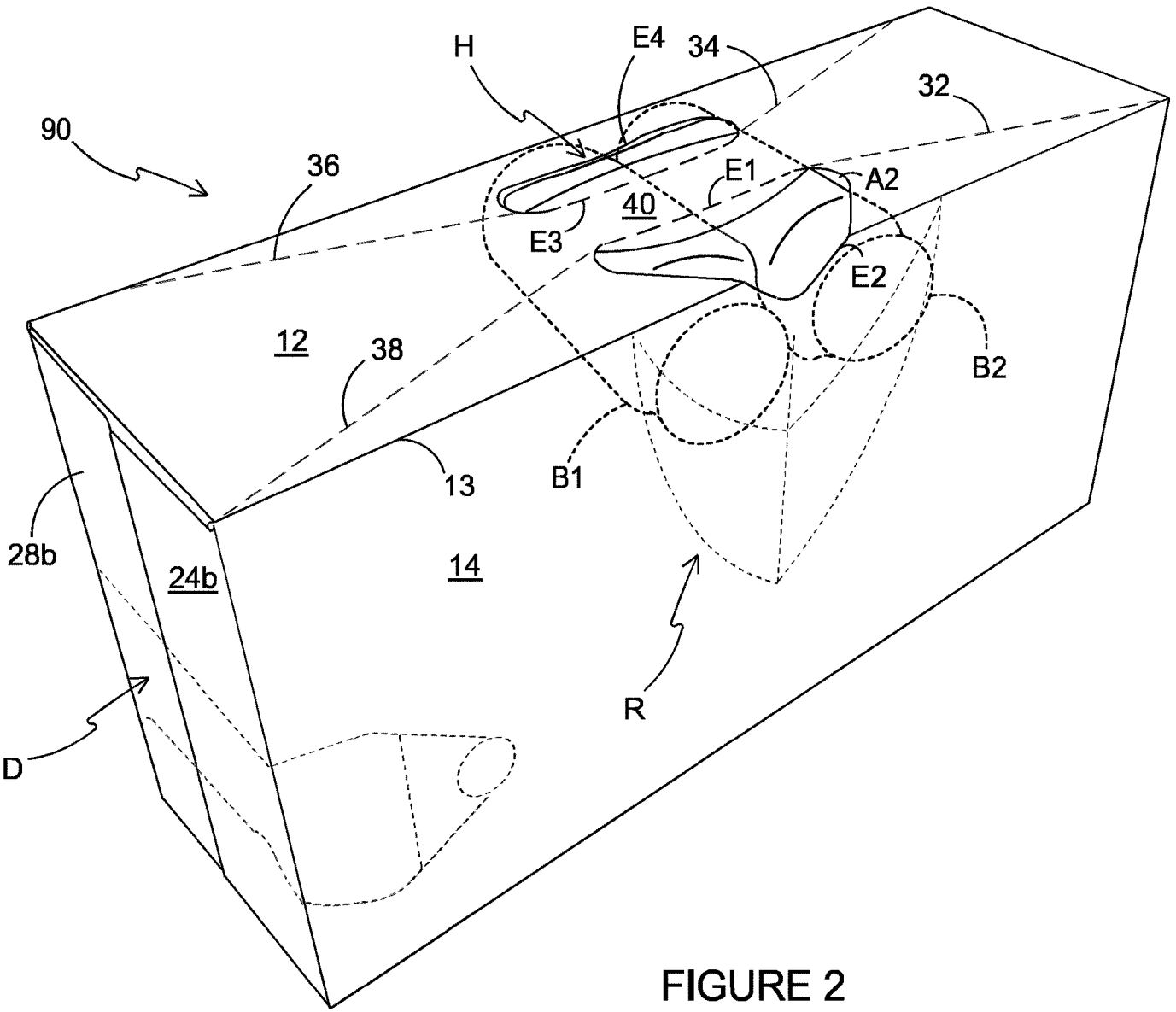
FIG. 2 is a perspective view from above of a carton formed from the blank of FIG. 1.

Referring to FIGS. 1 and 2 there is shown a blank 10 for forming a carton 90 capable of accepting an input of primary products such as, but not limited to, bottles or cans, hereinafter referred to as articles. Alternative blanks 110, 210, 310, 410 for forming alternative cartons are shown in FIGS. 3 to 5B.

In the embodiments detailed herein, the terms "carton" and "carrier" refer, for the non-limiting purpose of illustrating the various features of the invention, to a container 90 for engaging and carrying articles B1, B2, such as primary product containers B1, B2. It is contemplated that the teachings of the invention can be applied to various product containers B1, B2, which may or may not be tapered and/or cylindrical. Other exemplary containers include bottles (for example metallic, glass or plastics bottles), cans (for example aluminium cans), tins, pouches, packets and the like.

The blanks 10, 110, 210, 310, 410 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blanks 10, 110, 210, 310, 410 are configured to form a carton or carrier 90 for packaging an exemplary arrangement of exemplary articles B. In the illustrated embodiments, the arrangement is an m×n matrix or array, having three rows (m=3) and six columns (n=6); in the illustrated embodiment three rows of six articles B1, B2 are provided, and the articles B1, B2 are cans. Alternatively, the blanks 10, 110, 210, 310, 410 can be configured to form a carrier for packaging other types, number and size of articles B1, B2 and/or for packaging articles B1, B2 in a different arrangement or configuration.

Turning to FIG. 1, the blank 10 comprises a plurality of main panels 12, 14, 16, 18, 20, hinged one to the next in a linear series. A first, outer, top wall panel 12 is hinged to a first side wall panel 14 by a hinged connection such as a fold line 13. A base wall panel 16 is hinged to the first side wall panel 14 by a hinged connection such as a fold line 15. A second side wall panel 18 is hinged to the base wall panel 16 by a hinged connection in the form of a fold line 17. A second inner top wall panel 20 is hinged to the second side wall panel 18 by a hinged connection such as a fold line 19.

The plurality of main panels 12, 14, 16, 18, 20 of the blank 10 form walls of an open ended tubular structure in a set-up condition. The tubular structure is at least partially closed by end closure structures. The tubular structure has a tubular axis defining a longitudinal direction.

Each of the ends of the tubular structure is at least partially closed by end closure panels which form end walls of the tubular structure. In the illustrated embodiment, the ends of the tubular structure are fully closed by end closure panels 22*a*, 24*a*, 26*a*, 28*a*, 30*a*, 22*b*, 24*b*, 26*b*, 28*b*, 30*b*.

End closure panels 22*a*, 24*a*, 26*a*, 28*a*, 30*a* are configured to close a first end of the tubular structure and end closure panels 22*b*, 24*b*, 26*b*, 28*b*, 30*b* are configured to close a second end of the tubular structure.

The first end of the tubular structure is closed by a first end closure panel 22*a*, a second end closure panel 24*a*, a third end closure panel 26*a*, a fourth end closure panel 28*a* and a fifth end closure panel 30*a*. The first end closure panel 22*a* is hinged to a first end of the first top wall panel 12 by a hinged connection such as fold line 21*a*. The second end closure panel 24*a* is hinged to a first end of the first side wall panel 14 by a hinged connection such as fold line 23*a*. The third end closure panel 26*a* is hinged to a first end of the base wall panel 16 by a hinged connection such as fold line 25*a*. The fourth end closure panel 28*a* is hinged to a first end of the second side wall panel 18 by a hinged connection such as fold line 27*a*. The fifth end closure panel 30*a* is hinged to a first end of the second top wall panel 20 by a hinged connection such as fold line 29*a*.

The second end of the tubular structure is closed by a sixth end closure panel 22*b*, a seventh end closure panel 24*b*, an eighth end closure panel 26*b*, a ninth end closure panel 28*b* and a tenth end closure panel 30*b*. The sixth end closure panel 22*b* is hinged to a second end of the first top wall panel 12 by a hinged connection such as fold line 21*b*. The seventh end closure panel 24*b* is hinged to a second end of the first side wall panel 14 by a hinged connection such as fold line 23*b*. The eighth end closure panel 26*b* is hinged to a second end of the base wall panel 16 by a hinged connection such as fold line 25*b*. The ninth end closure panel 28*b* is hinged to a second end of the second side wall panel 18 by a hinged connection such as fold line 27*b*. The tenth end closure panel 30*b* is hinged to a second end of the second top wall panel 20 by a hinged connection such as fold line 29*b*.

The first and fifth end closure panel 22*a*, 30*a* and the sixth and tenth end closure panel 22*b*, 30*b* each form a minor upper end closure panel or upper dust flap at opposing ends of the tubular structure. The third end closure panel 26*a* and the eighth end closure panel 26*b* each form a minor lower end closure panel or lower dust flap at opposing ends of the tubular structure.

The second end closure panel 24*a* and the fourth end closure panel 28*a* each form a major side end closure panel at the first end of the tubular structure. The seventh end closure panel 24*b* and the ninth end closure panel 28*b* each form a major side end closure panel at the second end of the tubular structure.

Optionally, the blank 10 comprises a plurality of weakened lines of severance 60*a*, 60*b*, 60*c*, 60*d*, 60*e*, 60*f*, 60*g*, 62*a*, 62*b*, 62*c*, 62*d*, 62*e* which together form an access means D or dispenser in a set-up carton 90, as shown in FIG. 2, for facilitating access to the articles B being packaged. The plurality of weakened lines of severance 60*a*, 60*b*, 60*c*, 60*d*, 60*e*, 60*f*, 60*g*, 62*a*, 62*b*, 62*c*, 62*d*, 62*e* together form a continuous loop in a set-up carton.

A first series of weakened lines of severance 60*a*, 60*b*, 60*c*, 60*d*, 60*e*, 60*f*, 60*g* is provided in part in the first side panel 14 and in part in the seventh end closure panel 24*b* and form a first part D1 of the dispenser D. The first series of weakened lines of severance 60*a*, 60*b*, 60*c*, 60*d*, 60*e*, 60*f*, 60*g* commences from a free end edge of the seventh end closure panel 24*b* and extends across the seventh end closure panel 24*b* into the first side panel 14. The first series of weakened lines of severance 60*a*, 60*b*, 60*c*, 60*d*, 60*e*, 60*f*, 60*g* is substantially "V" shaped. The first series of weakened lines of severance 60*a*, 60*b*, 60*c*, 60*d*, 60*e*, 60*f*, 60*g* returns into the seventh end closure panel 24*b*, extends across the seventh end closure panel 24*b*, and terminates at the free end edge of the seventh end closure panel 24*b*. The first side panel 14 comprises an optional first arcuate fold line 63 which is substantially "C" shaped. Each end of the arcuate fold line 63 intersects or meets with one of the first series of weakened lines of severance 60*d*, and forms a tear initiation device I. First side panel 14 comprises an optional linear fold line 61 spaced from the "C" shaped fold line 63. Each end of the linear fold line 61 intersects or meets with one of a respective pair 60*c*, 60*e* of the first series of weakened lines of severance 60*a*, 60*b*, 60*c*, 60*d*, 60*e*, 60*f*, 60*g*.

A second series of weakened lines of severance 62*a*, 62*b*, 62*c*, 62*d*, 62*e* is provided in part in the second side panel 18 and in part in the ninth end closure panel 28*b*. The second series of weakened lines of severance 62*a*, 62*b*, 62*c*, 62*d*, 62*e* commences from a free end edge of the ninth end closure panel 28*b* and extends across the ninth end closure panel 28*b* into the second side panel 18. The second series of weakened lines of severance 62*a*, 62*b*, 62*c*, 62*d*, 62*e* is substantially "U" shaped in the second side panel 18. The second series of weakened lines of severance 62*a*, 62*b*, 62*c*, 62*d*, 62*e* returns into the ninth end closure panel 28*b*, extends across the ninth end closure panel 28*b*, and terminates at the free end edge of the ninth end closure panel 28*b*.

The access means D, defined by plurality of weakened lines of severance 60*a*, 60*b*, 60*c*, 60*d*, 60*e*, 60*f*, 60*g*, 62*a*, 62*b*, 62*c*, 62*d*, 62*e*, is arranged to be in closer proximity to the base wall panel 16 than to the composite top wall panel 12/20 in a setup carton. In alternative embodiments, the access means D may be arranged to be in closer proximity to the composite top wall panel 12/20, or evenly spaced between the composite top wall panel 12/20 and the base wall panel 16. It will be appreciated that the access means D can be arranged to be in closer proximity to the composite top wall panel 12/20 without affecting the integrity of a carrying handle H.

The blank 10 comprises a handle structure for forming the carrying handle H, the handle structure is denoted generally by reference signs H1 and H2. The first top wall panel 12 comprises a first part H1 of the handle structure. The second top wall panel 20 comprises a second part H2 of the handle structure. The second part H2 of the handle structure reinforces or strengthens the first part H1 of the handle structure provided by the first top wall panel 12.

The first part H1 of the handle structure comprises a first handle cutaway and a second handle cutaway. The first handle cutaway is formed, at least in part, by a first aperture A1. The first aperture A1 is struck from the first top wall panel 12. The second handle cutaway is formed, at least in part, by a second aperture A2. The second aperture A2 is struck in part from the first top wall panel 12 and in part from the first side wall panel 14.

The first handle cutaway is elongate in shape and is disposed such that an elongate axis of the first handle opening is oriented substantially parallel with the longitudinal axis of the carton 90. The first handle cutaway comprises a pair of opposed side edges E3, E4; a first, inner, edge E3 and a second outer edge E4.

The second handle cutaway is substantially triangular in shape and is disposed such that a first, inner, edge E1 thereof is oriented substantially parallel with the longitudinal axis of the carton 90. A second, outer, edge E2 substantially opposes the first edge E1 and may be substantially "V" shaped.

The first and second handle cutaways are spaced apart from each other and define a handle strap 40*a* therebetween. The handle strap 40*a* is orientated so as to extend in a direction parallel to the longitudinal or tubular axis of the carton 90 when in a set-up condition.

Optionally, the first handle cutaway is defined at least in part by a first displaceable flap 42 struck from the first top wall panel 12 and hingedly connected to the first top wall panel 12 by a fold line 41. Fold line 41 may define at least in part a first or inner edge E3 of a first handle opening formed in the composite top wall 12/20 of the carton 90. The first displaceable flap 42 may form a first cushioning flap when the carrying handle H is in use.

Optionally, the second handle cutaway is defined at least in part by a second displaceable flap 44 struck from the first top wall panel 12 and hingedly connected to the first top wall panel 12 by a fold line 43. Fold line 43 may define at least in part the first or inner edge E1 of a second handle opening formed in the composite top wall 12/20 of the carton 90. In some embodiments, the displaceable flap 44 may be struck in part from the first side wall panel 14. The second displaceable flap 44 may form a second cushioning flap when the carrying handle H is in use.

Optionally, the blank 10 comprises a plurality of fold lines 32, 34, 36, 38 which form part of the handle structure H. Each fold line 32, 34, 36, 38 predefines preferred locations at which the first top wall panel 12 folds when the carrying handle H is employed. The fold lines 32, 34, 36, 38 form part of a folding device or structure which controls or directs the load forces applied to the carton 90 when the carrying handle H is employed.

A first pair of fold lines 32, 38 defines a first side edge of the carrying handle H. A first fold line 32 extends from a first end of the second handle opening towards or into a first corner of the first top wall panel 12. A second fold line 38 extends from a second, opposing, end of the second handle opening towards or into a second corner of the first top wall panel 12. The first corner of the first top wall panel 12 is defined by a vertex formed by the intersection of fold line 23*a* and fold line 15. The second corner of the first top wall panel 12 is defined by a vertex formed by the intersection of fold line 23*b* and fold line 15.

A second pair of fold lines 34, 36 defines a second side edge of the carrying handle H. A third fold line 34 extends from a first end of the first handle opening towards a free edge of the first top wall panel 12 and terminates proximate the fold line 23*a*. A fourth fold line 38 extends from a second, opposing, end of the first handle opening towards the free edge of the first top wall panel 12 and terminates proximate the fold line 23*b*.

The second part H2 of the handle structure comprises a third handle cutaway and a fourth handle cutaway. The third handle cutaway is formed by a third aperture A3. The third handle cutaway is elongate in shape and is disposed such that an elongate axis of the first handle cutaway is oriented substantially parallel with the longitudinal axis of the carton 90. The fourth handle cutaway provided by a cutaway or recess C struck from a free edge of the second top wall panel 20. The cutaway C is elongate in shape and is disposed such that an elongate axis of the cutaway C is oriented substantially parallel with the longitudinal axis of the carton 90.

The third aperture A3 and cutaway C are spaced apart from each other and define a reinforcing handle strap 40*b* therebetween. The reinforcing handle strap 40*b* is orientated so as to extend in a direction parallel to the longitudinal or tubular axis of the carton 90 when in a set-up condition.

Optionally, the blank 10 comprises a plurality of fold lines 45, 46, 47, 48 which form part of the handle structure H. Each fold line 45, 46, 47, 48 predefines preferred locations at which the second top wall panel 20 folds when the carrying handle H is employed. The fold lines 45, 46, 47, 48 form part of a folding device or structure which controls or directs the load forces applied to the carton 90 when the carrying handle H is employed.

A third pair of fold lines 46, 45 defines the second side edge of the carrying handle H. A fifth fold line 46 extends from a first end of the third handle cutaway towards or into a first corner of the second top wall panel 20 and a sixth fold line 45 extends from a second, opposing, end of the third handle cutaway towards or into a second corner of the second top wall panel 20. The first corner of the second top wall panel 20 is defined by a vertex formed by the intersection of fold line 29*a* and fold line 19. The second corner of the second top wall panel 20 is defined by a vertex formed by the intersection of fold line 29*b* and fold line 19.

A fourth pair of fold lines 47, 48 defines a second side edge of the carrying handle H. A seventh fold line 48 extends from a first end of the fourth handle cutaway towards a free edge of the second top wall panel 20. An eighth fold line 47 extends from a second, opposing, end of the fourth handle cutaway towards the free edge of the second top wall panel 12.

In the set-up carton, the first aperture A1 and the third aperture A3 are disposed in vertical registry to form a first handle opening in a composite top wall 12/20 formed from the first and second top wall panels 12, 20. The second aperture A2 and the cutaway C are disposed in vertical registry to form a second handle opening in the composite top wall 12/20 of the carton.

Optionally, the blank 10 comprises a relief structure R defined in each of the first and second side wall panels 14, 18. The relief structures R form part of the handle structure. Each of the relief structure R are substantially similar in construction and will be described in further detail by reference to the relief structure R formed in the first side wall panel 14.

The relief structure R comprises a plurality of score lines or predefined fold lines. The fold lines are defined the first side wall panel 14.

The relief structure R comprises a first fold line fold line 54, the first fold line 54 may be linear or straight, and extends partially across the first side wall panel 14.

The first fold line 54 is located centrally with respect to the second aperture A2. The first fold line 54 may be disposed equidistant from the fold line 23*a* and the fold line 23*b*. The relief structure R further comprises a pair of first arms in the form of arcuate fold lines 56 and 58. The pair of first arms 56, 58 extend respectively from two spaced locations along the fold line 13, hinging the first top wall panel 12 to the first side wall panel 14. Each of the pair of first arms 56, 58 intersects with the fold line 13 at a respective one of the two spaced locations along the fold line 13.

One of the first arms 56 extends from the fold line 13 and terminates at a first, lower, end of the first fold line 54.

The other of the first arms 58 extends from the fold line 13 and terminates at the first end of the first fold line 54.

The first fold line 54 and a respective one of the pair of first arms 56, 58 in combination with the fold line 13 define substantially triangular shaped portions of the first side wall panel 14. The triangular shaped portions of the first side wall panel 14 are disposed back to back with each other.

The first arms 56 and 58 meet at a common vertex V2 disposed on the first fold line 54 within the first side wall panel 14. The common vertex V2 in other words is a first point of intersection of the first arms 56 and 58. The first arms 56 and 58 of the pair together provides a first substantially "V" shaped fold line.

The relief structure R further comprises a pair of second arms in the form of arcuate fold lines 50, 52.

Each of the second arms 50, 52 extends from a location proximate one of the two spaced locations upon the fold line 13 at which one of the first arms 56, 58 intersect the fold line 13.

The second arms 50, 52 extend to and terminate at a second point of intersection V1 disposed on the first fold line 54 at a location between the fold line 13 and the lower terminal end (or the first point of intersection V2) of the first fold line 54. The second arms 50, 52 of the pair together provide a second substantially "V" shaped fold line.

Each of the first and second substantially "V" shaped fold lines is bisected by the first fold line 54. Each of the first and second "V" shaped fold lines point or converge towards the base wall panel 16.

The second aperture A2 is arranged to cooperate with the relief structure R. The second aperture A2 is struck in part from the first side wall panel 12. The first fold line 54 is aligned with the second apertures A2 so as to terminate proximate a corner of the second aperture A2.

The second aperture A2 is arranged to create a cutaway in the first side wall panel which is disposed centrally with respect to the plurality of score lines. The plurality of score lines define or control deformation of the first side wall panel 12 when the carrying handle H is in use. The second aperture A2 facilitates deformation of the first side wall panel 12 allowing a region of the first side wall panel 12 proximate or adjacent to the first fold line 54 to bow or displace inwardly. It may also facilitate deformation of sections of the fold line 13 proximate to the second aperture A2 or relief structure R.

The carton 90, shown in FIG. 2, can be formed by a series of sequential folding operations in a straight line machine so that the carton 90 may not be required to be rotated or inverted to complete its construction. The folding process is not limited to that described below and may be altered according to particular manufacturing requirements. During loading and assembly of the carton 90, the carton 90 may be orientated such that one of the first and second side wall panels 14, 18 forms a loading surface. The bases of one or more articles may be in sliding contact with the loading surface when being inserted into the carton 90. The articles may be substantially cylindrical in shape and have a cylindrical axis. The cylindrical axis may be orientated perpendicularly to the first side wall panel 14 and the second side wall panel. During loading and assembly, the cylindrical axis of the articles may be orientated substantially vertically. When the carrying handle H and/or the dispenser D are employed the cylindrical axis of the articles may be orientated substantially horizontally; the articles, or at least a lowermost row of articles, may be at rest upon the base panel 16. The cylindrical side wall of the articles in the lowermost row of articles may be in contact with the base panel 16.

The main panels 12, 20 form a composite top wall 12/20 when the handle structure H is in use as a carrying handle by a user and this composite top wall 12/20 is optionally, disposed adjacent to the sides of the articles. In this orientation, the composite top wall 12/20 is not disposed substantially planar to the tops or bottoms of the articles held within the carton 90. In other words, the cylindrical axis of the articles is substantially parallel with the plane of the composite top wall 12/20 of the carton 90.

The main panel 16 forms the base wall 16 when the handle structure H is in use as a carrying handle by a user. The main panel 16 may also form the base wall 16 when the articles are being dispensed from the carton 90 or when the carton 90 is at rest upon a surface such as a shelf. As such, it will be understood that descriptive terms "top", "base", and "side" do not necessarily limit the carton 90 to adopting a particular orientation but serve to distinguish those panels from one another. In other embodiments, the cylindrical axis of the articles may be orientated differently with respect to the composite top wall 12/20, or base wall 16, of the carton 90. For example, but not limited to, the cylindrical axis of the articles be may orientated substantially perpendicularly to the plane of the top wall 12/20, or base wall 16, of the carton 90.

Turning to the construction of the carton 90 as illustrated in FIG. 2, the blank 10 is folded about the fold line 19 such that the second top wall panel 20 is disposed in overlying relationship with the second side wall panel 18.

Glue G or other adhesive treatment is applied to an outer surface of the second top wall panel 20. Alternatively, glue G or other adhesive treatment may be applied to a corresponding portion of an inner surface of the first top wall panel 12.

Glue G or other adhesive treatment is applied to an outer surface of the fifth and tenth end closure panels 30*a*, 30*b*. Alternatively, glue G or other adhesive treatment may be applied to a corresponding portion of an inner surface of the first and sixth end closure panels 22*a*, 22*b*.

The blank 10 is folded about the fold line 15 such that the first top wall panel 12 is disposed in overlying relationship with the second top wall panel 20 and the first side wall panel 14 is disposed in overlying relationship with the base wall panel 16 and a part of the second side wall panel 18. The first top wall panel 12 is secured to the second top wall panel 20. The first end closure panel 22*a* is secured to the fifth end closure panel 30*a*. The sixth end closure panel 22*b* is secured to the tenth end closure panel 30*b*.

The blank 10 is thus formed into a flat collapsed tubular structure which can be readily shipped or distributed to a convertor plant, at which the flat collapsed tubular structure may be erected into an open ended tubular structure and loaded with articles.

The flat collapsed tubular structure may be erected to form an open ended tubular structure by unfolding the first side wall panel 14 with respect to the base wall panel 16 such that the first side wall panel 14 is disposed substantially perpendicularly with respect to the base wall panel 16.

The carton 90, in its open ended tubular form, may be loaded with articles through one or both open ends thereof. It will be appreciated that in some embodiments one of the open ends of the carton 90 may be closed before loading the interior with articles through the remaining open end.

Once the carton 90 has been loaded with articles the open ends of the carton 90 are closed.

A first end of the tubular structure is closed by folding the first and fifth end closure panels 22*a* about fold lines 21*a*, 29*a* respectively and by folding the third end closure panel 26*a* about fold line 25*a*.

Glue or other adhesive treatment may be applied to a first portion of an inner surface of the second end closure panel 24*a*. In alternative embodiments glue or other adhesive treatment may be applied to a corresponding portion of an outer surface of first end closure panel 22*a*.

Glue or other adhesive treatment may be applied to a second portion of an inner surface of the second end closure panel 24*a*. In alternative embodiments glue or other adhesive treatment may be applied to a corresponding portion of an outer surface of third end closure panel 26*a*.

The second end closure panel 24*a* is then folded about the fold line 23*a* to be brought into contact with the first and third end closure panels 22*a*, 26*a*. The second end closure panel 24*a* may be secured to each of the first and third end closure panels 22*a*, 26*a*.

Glue or other adhesive treatment is applied to a portion of an inner surface of the fourth end closure panel 28*a*. In alternative embodiments glue or other adhesive treatment may be applied to a portion of an outer surface of the second end closure panel 24*a*.

Optionally, glue or other adhesive treatment may be applied to a first portion of an inner surface of the fourth end closure panel 28*a*. In alternative embodiments glue or other adhesive treatment may be applied to a corresponding portion of an outer surface of first end closure panel 22*a*.

Optionally, glue or other adhesive treatment may be applied to a second portion of an inner surface of the fourth end closure panel 28*a*. In alternative embodiments glue or other adhesive treatment may be applied to a corresponding portion of an outer surface of third end closure panel 26*a*.

The fourth end closure panel 28*a* is then folded about the fold line 27*a* to be brought into contact with the second end closure panel 24*a* and optionally into contact with the first and third end closure panels 22*a*, 26*a*.

The fourth end closure panel 28*a* is secured to the second end closure panel 24*a*. The fourth end closure panel 28*a* may be secured to the first and third end closure panels 22*a*, 26*a*, for example by glue or other adhesive treatment.

In alternative embodiments, the second end closure panel 24*a* may be folded about fold line 23*a* after folding the fourth end closure panel 28*a* about fold line 27*a*. It will be appreciated that in such embodiments the second end closure panel 24*a* is disposed outermost.

In other embodiments, alternative securing means may be employed to secure the end closure panels 22*a*, 24*a*, 26*a*, 28*a*, 30*a*; 22*b*, 24*b*, 26*b*, 28*b*, 30*b* for example, but not limited to, mechanical locking devices such as staples or punch locks integrally formed within the end closure panels 22*a*, 24*a*, 26*a*, 28*a*, 30*b*; 22*b*, 24*b*, 26*b*, 28*b*, 30*b*.

A second end of the tubular structure is closed by folding the sixth and tenth end closure panels 22*b*, 30*b* about fold lines 21*b*, 29*b* respectively and by folding the eighth end closure panel 26*b* about fold line 25*b*.

The seventh end closure panel 24*b* is then folded about the fold line 23*b* to be brought into contact with the sixth and eighth end closure panels 22*b*, 26*b*. Optionally, the seventh end closure panel 24*b* may be secured to each of the sixth and eighth end closure panels 22*b*, 26*b*.

Glue or other adhesive treatment is applied to a portion of an outer surface of the seventh end closure panel 24*b*, glue may be applied in one or more strips extending substantially parallel to the free end edge of the seventh end closure panel 24*b*. Alternatively, glue may be applied in alternative patterns such as glue spots. In alternative embodiments glue or other adhesive treatment may be applied to a portion of an inner surface of the ninth end closure panel 28*b*.

The ninth end closure panel 28*b* is then folded about the fold line 27*b* to be brought into contact with the seventh end closure panel 24*b* and optionally into contact with the sixth and eighth end closure panels 22*b*, 26*b*.

The ninth end closure panel 28*b* is secured to the seventh end closure panel 24*b*. Optionally, the ninth end closure panel 28*b* may be secured to the sixth and eighth end closure panels 22*b*, 26*b*, for example by glue or other adhesive treatment.

In this way the plurality of weakened lines of severance 60*a*, 60*b*, 60*c*, 60*d*, 60*e*, 60*f*, 60*g*, 62*a*, 62*b*, 62*c*, 62*d*, 62*e* form a continuous loop. A tear strip is formed, the tear strip comprises a portion of the first side wall panel 14, portions T1, T2 of the seventh and ninth end closure panels 24*b*, 28*b* respectively and a portion of the second side wall panel 18. The portion T1 of the seventh end closure panel 24*b* and the portion T2 of the ninth end closure panel 28*b* are disposed in at least partial overlapping relationship with each other and are secured to each other to form a continuous detachable strip.

FIG. 2 illustrates the assembled carton 90 forming a package.

Referring to FIG. 2 the carton 90 comprises a carrying handle, the carrying handle comprises first and second handle openings. The first handle opening is disposed within the composite top wall 12/20. The second handle opening is disposed in part in the composite top wall 12/20 and in part in the first side wall 14.

The first handle opening comprises a first or inner side edge E3 and a second outer side edge E4. The first side edge E3 may be defined at least in part by the fold line 41 coupling the cushioning flap 40 to the handle strap 40*a*.

The first side edge E3 is reinforced, that is to say, the composite top wall 12/20 is of multiply construction along the first side edge E3. In the illustrated embodiment, the composite top wall 12/20 is a two-ply construction along the first side edge E3. The handle strap 40*a* provided by the first top wall panel 12 is reinforced by the reinforcing handle strap 40*b* provided by the second top wall panel 20.

The second side edge E4 is reinforced the composite top wall 12/20 is of multiply construction along the second side edge E4. In the illustrated embodiment, the composite top wall 12/20 is a two-ply construction along the second side edge E4.

The composite top wall 12/20 provides a two ply portion disposed between the first handle opening and an adjacent portion of the fold line 19 which defines a first side edge of the composite top wall 12/20.

The first handle opening therefore provided two opposing side edges E3, E4 which are reinforced or multiply construction. It is envisaged that used will employ the carrying handle be grasping a central handle 40 provided by the handle strap 40*b* and the reinforcing handle strap 40*b*, inserting one or more fingers through one of the first and second handle openings and a thumb through the other of the first and second handle openings.

Alternatively, users may engage the composite top wall 12/20 by inserting one or more fingers through the first handle opening and engaging one of the first or second edges E3, E4 (both of which are reinforced) of the first handle opening so as to carry the carton 90 by the central handle strap or by the portion of the composite top panel 12/20—between the first handle opening and the fold line 19—adjacent to the second edge E4.

The second handle opening comprises a first or inner side edge E1 and a second outer side edge E2. The first side edge E1 may be defined at least in part by the fold line 43 coupling the cushioning flap 42 to the handle strap 40*a*.

The first side edge E1 is reinforced, that is to say, the composite top wall 12/20 is of multiply construction along the first side edge E1. In the illustrated embodiment, the composite top wall 12/20 is a two-ply construction along the first side edge E1. The handle strap 40*a* provided by the first top wall panel 12 is reinforced by the reinforcing handle strap 40*b* provided by the second top wall panel 20.

The second side edge E2 is not reinforced, that is to say, the composite top wall 12/20 is of single ply construction along the second side edge E2. This has the advantage of reducing the width of the second inner top wall panel 20, thus reducing the amount of material the blank 10 requires to provide the carton 90.

The second handle opening, in particular the second aperture A2, is adapted and configured to discourage users from employing the second handle opening, independently of the first handle opening, as a means for carrying the carton 90. The second aperture A2 comprises a second edge E2 provided in part by the first top wall panel 12 and in part by the first side wall panel 14. The second edge E2 is nonlinear in shape, in particular the second edge E2 is substantially "V" shaped, converging towards the base panel 16. In this way, the second edge E2 is disposed in close proximity or alignment with the articles being packaged.

The second aperture A2 is similarly shaped and aligned with a void between two adjacent articles B1, B2 which are disposed proximate the carrying handle H. In this way, the carton 90 does not present a panel portion an internal surface of which is readily engageable by a user. In contrast to the first handle opening it is difficult for a user to insert one or more fingers through the second aperture A2 and hook said finger under the composite top panel 12/20 along the second edge E2; the second edge E2 being a single ply or a non-reinforced edge. The second edge E2 is presented to the user as a non-engaging edge; the user can intuit from the shape and configuration of the second opening the optimum or designed method of employing, engaging with, the carrying handle H.

Referring now to FIGS. 3 to 5B, there is shown additional embodiments of the present disclosure. In the second, third, fourth and fifth illustrated embodiments like numerals have, where possible, been used to denote like parts, albeit with the addition of the prefix "100", "200", "300", "400" to indicate that these features belong to the second, third, fourth or fifth embodiment respectively. The additional embodiments share many common features with the first embodiment and therefore only the differences from the embodiment illustrated in FIGS. 1 and 2 will be described in detail.

Figure 3:
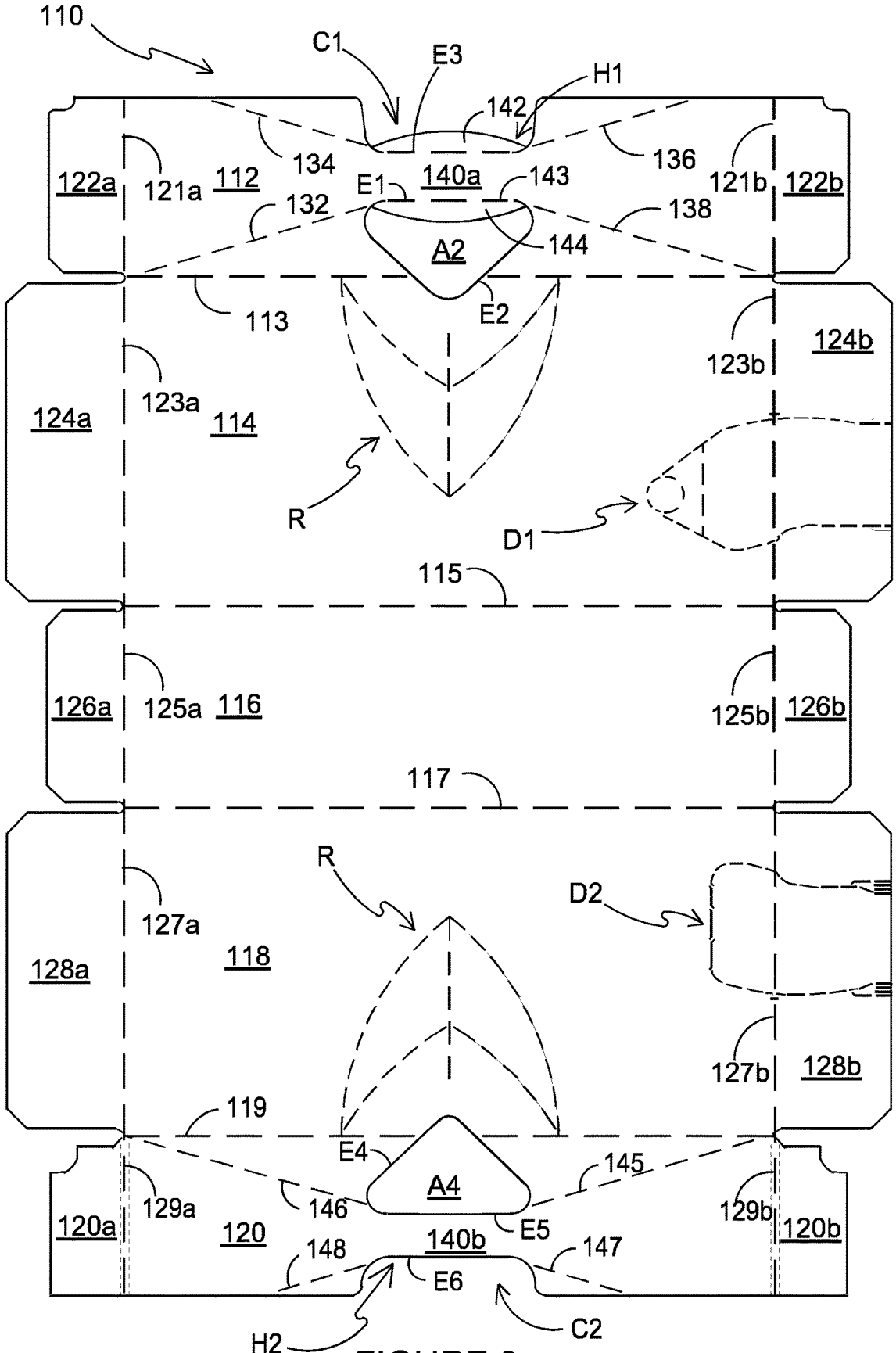
FIG. 3 is a plan view from above of a blank for forming a carton according to a second embodiment of the invention.

FIG. 3 shows a blank 110 for forming a carton, the blank 110 comprises a plurality of main panels 112, 114, 116, 118, 120, hinged one to the next in a linear series. A first top wall panel 112 is hinged to a first side wall panel 114 by a hinged connection such as a fold line 113. The first side wall panel 114 is hinged to a base wall panel 116 by a hinged connection such as a fold line 115. A second side wall panel 118 is hinged to the base wall panel 116 by a hinged connection such as a fold line 117. A second top wall panel 120 is hinged to a second side wall panel 118 by a hinged connection such as a fold line 119.

The plurality of main panels 112, 114, 116, 118, 120 of the blank 110 form walls of an open ended tubular structure in a set-up condition. The tubular structure is at least partially closed by end closure structures. The tubular structure has a tubular axis defining a longitudinal direction.

Each of the ends of the tubular structure is at least partially closed by end closure panels which form end walls of the tubular structure. In the illustrated embodiment, the ends of the tubular structure are fully closed by end closure panels 122*a*, 124*a*, 126*a*, 128*a*, 130*a*, 122*b*, 124*b*, 126*b*, 128*b*, 130*b*.

End closure panels 122*a*, 124*a*, 126*a*, 128*a*, 130*a* are configured to close a first end of the tubular structure and end closure panels 122*b*, 124*b*, 126*b*, 128*b*, 130*b* are configured to close a second end of the tubular structure.

The first end of the tubular structure is closed by a first end closure panel 122*a*, a second end closure panel 124*a*, a third end closure panel 126*a*, a fourth end closure panel 128*a* and a fifth end closure panel 130*a*. The first end closure panel 122*a* is hinged to a first end of the first top wall panel 112 by a hinged connection such as fold line 121*a*. The second end closure panel 124*a* is hinged to a first end of the first side wall panel 114 by a hinged connection such as fold line 123*a*. The third end closure panel 126*a* is hinged to a first end of the base wall panel 116 by a hinged connection such as fold line 125*a*. The fourth end closure panel 128*a* is hinged to a first end of the second side wall panel 118 by a hinged connection such as fold line 127*a*. The fifth end closure panel 130*a* is hinged to a first end of the second top wall panel 120 by a hinged connection such as fold line 129*a*.

The second end of the tubular structure is closed by a sixth end closure panel 122*b*, a seventh end closure panel 124*b*, an eighth end closure panel 126*b*, a ninth end closure panel 128*b* and a tenth end closure panel 130*b*. The sixth end closure panel 122*b* is hinged to a second end of the first top wall panel 112 by a hinged connection such as fold line 121*b*. The seventh end closure panel 124*b* is hinged to a second end of the first side wall panel 114 by a hinged connection such as fold line 123*b*. The eighth end closure panel 126*b* is hinged to a second end of the base wall panel 116 by a hinged connection such as fold line 125*b*. The ninth end closure panel 128*b* is hinged to a second end of the second side wall panel 118 by a hinged connection such as fold line 127*b*. The tenth end closure panel 130*b* is hinged to a second end of the second top wall panel 120 by a hinged connection such as fold line 129*b*.

The blank 110 comprises a handle structure for forming the carrying handle, the handle structure is denoted generally by reference signs H1 and H2. The first top wall panel 112 comprises a first part H1 of the handle structure. The second top wall panel 120 comprises a second part H2 of the handle structure. The second part H2 of the handle structure reinforces or strengthens the first part H1 of the handle structure provided by the first top wall panel 112.

The first part H1 of the handle structure comprises a first handle cutaway and a second handle cutaway.

The first handle cutaway is provided by a first cutaway or recess C1 struck from a free edge of the first top wall panel 112. The first cutaway C1 is elongate in shape and is disposed such that an elongate axis of the first cutaway C1 is oriented substantially parallel with the longitudinal or tubular axis of the carton.

Optionally, the first handle cutaway is defined at least in part by a first displaceable flap 142 struck from the first top wall panel 112 and hingedly connected to the first top wall panel 112 by a fold line 141. Fold line 141 may define at least in part a first or inner edge E3 of a first handle opening formed in the composite top wall 12/20 of a carton formed from blank 110. The first displaceable flap 142 may form a first cushioning flap when the carrying handle is in use.

The second handle cutaway is formed, at least in part, by a second aperture A2. The second aperture A2 is struck in part from the first top wall panel 112 and in part from the first side wall panel 114.

The second handle cutaway is substantially triangular in shape and is disposed such that a first edge E1 thereof is oriented substantially parallel with the longitudinal axis of the carton. A second, outer, edge E2 substantially opposes the first edge E1 and may be substantially "V" shaped.

Optionally, the second handle cutaway is defined at least in part by a second displaceable flap 144 struck from the first top wall panel 112 and hingedly connected to the first top wall panel 112 by a fold line 143. Fold line 143 may define at least in part a first or inner edge E1 of a second handle opening formed in the composite top wall 12/20 of a carton formed from blank 110. In some embodiments, the displaceable flap 144 may be struck in part from the first side wall panel 114. The second displaceable flap 144 may form a second cushioning flap when the carrying handle is in use.

The first and second handle cutaways are spaced apart from each other and define a handle strap 140*a* therebetween. The handle strap 140*a* is orientated so as to extend in a direction parallel to the longitudinal or tubular axis of the carton when in a set-up condition.

Optionally, the blank 110 comprises a plurality of fold lines 132, 134, 136, 138 which form part of the handle structure. Each fold line 132, 134, 136, 138 predefines preferred locations at which the first top wall panel 112 folds when the carrying handle is employed.

The second part H2 of the handle structure comprises a third handle cutaway and a fourth handle cutaway. The third handle cutaway is formed by a fourth aperture A4. The fourth aperture A4 is struck in part from the second top wall panel 120 and in part from the second side wall panel 118.

The third handle cutaway is substantially triangular in shape and is disposed such that a first edge E5 thereof is oriented substantially parallel with the longitudinal axis of the carton. A second, outer, edge E4 substantially opposes the first edge E5 and may be substantially "V" shaped.

The fourth handle cutaway provided by a second cutaway or recess C2 struck from a free edge of the second top wall panel 120. The second cutaway C2 is elongate in shape and is disposed such that an elongate axis of the second cutaway C2 is oriented substantially parallel with the longitudinal axis of the carton.

The fourth aperture A4 and second cutaway C2 are spaced apart from each other and define a reinforcing handle strap 140*b* therebetween. The reinforcing handle strap 140*b* is orientated so as to extend in a direction parallel to the longitudinal or tubular axis of the carton when in a set-up condition.

Optionally, the blank 10 comprises a plurality of fold lines 145, 146, 147, 148 which form part of the handle structure. Each fold line 145, 146, 147, 148 predefines preferred locations at which the second top wall panel 120 folds when the carrying handle is employed.

In a set-up carton, the second aperture A2 and the second cutaway C2 are disposed in vertical registry to form a first handle opening in a composite top wall of a carton formed from the first and second top wall panels 112, 120. The fourth aperture A4 and the first cutaway C1 are disposed in vertical registry to form a second handle opening in the composite top wall of the carton.

In the carton formed from the blank 110 both the first and second handle openings comprise a first, inner, edge which is reinforced and a second outer edge which is not reinforced. The first, inner, edges are reinforced by being of multi-ply construction, e.g., two-ply construction. The second, outer, edges are single ply in construction. The first and second top wall panels 112, 120 which together form the composite top wall of the carton are both narrower than the base panel 116. That is to say, neither of the first and second top wall panels 112, 120 extends fully across the carton in a transverse direction—between the first and second side wall panel 114, 118.

The blank 110 of the second illustrated embodiment (FIG. 3) is assembled in a substantially similar manner to the blank 10 of the first illustrated embodiment, FIG. 1 to form a carton.

Figure 4:
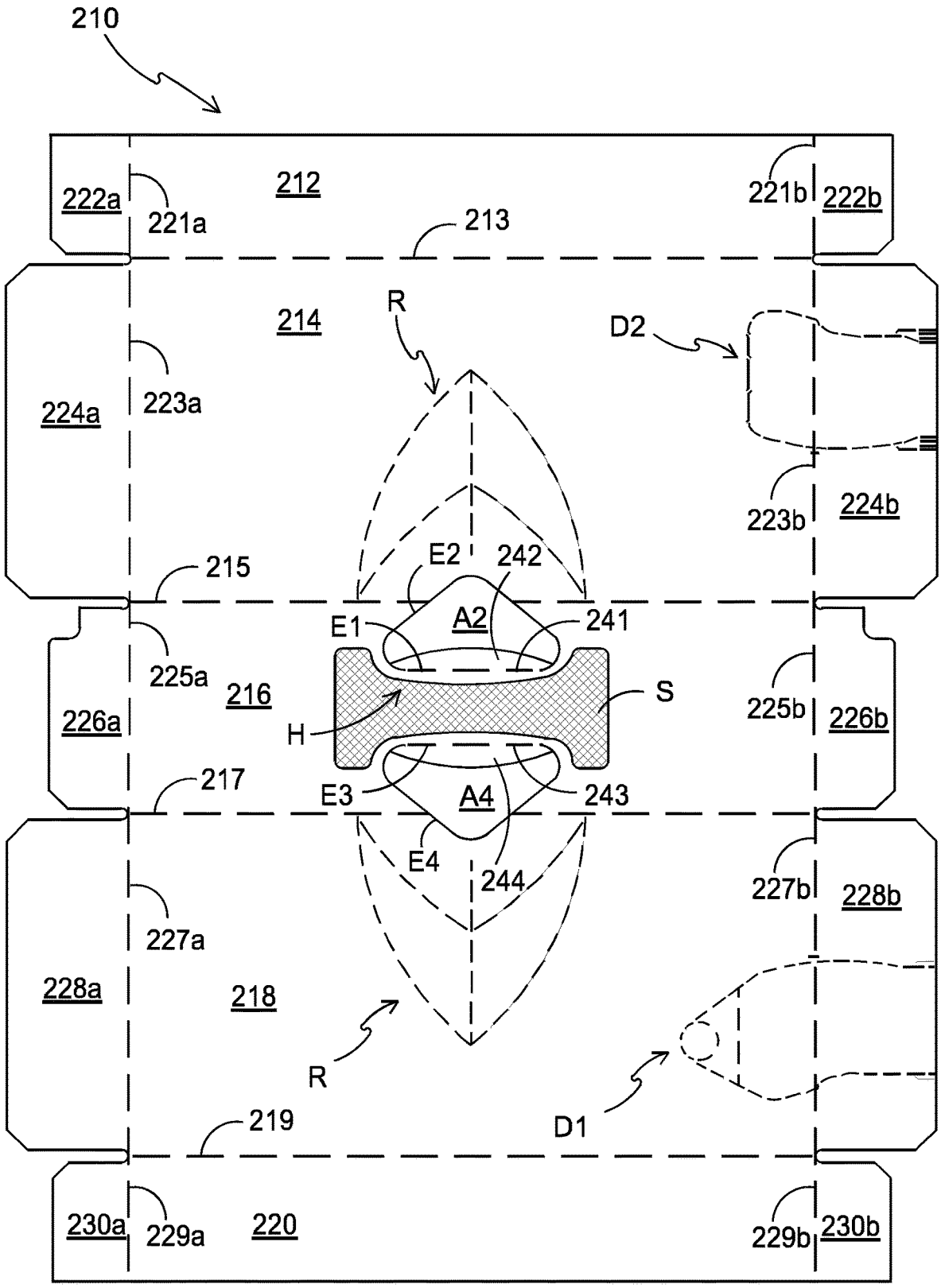
FIG. 4 is a plan view from above of a blank for forming a carton according to a third embodiment of the invention.

Referring now to FIG. 4, there is shown a blank 210 for forming a carton, the blank 210 comprises a plurality of main panels 212, 214, 216, 218, 220, hinged one to the next in a linear series. A first base wall panel 212 is hinged to a first side wall panel 214 by a hinged connection such as a fold line 213. The first side wall panel 214 is hinged to a top wall panel 216 by a hinged connection such as a fold line 215. A second side wall panel 218 is hinged to the top wall panel 216 by a hinged connection such as a fold line 217. A second base wall panel 220 is hinged to a second side wall panel 218 by a hinged connection such as a fold line 219.

The plurality of main panels 212, 214, 216, 218, 220 of the blank 210 form walls of an open ended tubular structure in a set-up condition. The tubular structure is at least partially closed by end closure structures. The tubular structure has a tubular axis defining a longitudinal direction.

Each of the ends of the tubular structure is at least partially closed by end closure panels which form end walls of the tubular structure. In the illustrated embodiment, the ends of the tubular structure are fully closed by end closure panels 222*a*, 224*a*, 226*a*, 228*a*, 230*a*, 222*b*, 224*b*, 226*b*, 228*b*, 230*b*.

End closure panels 222*a*, 224*a*, 226*a*, 228*a*, 230*a* are configured to close a first end of the tubular structure and end closure panels 222*b*, 224*b*, 226*b*, 228*b*, 230*b* are configured to close a second end of the tubular structure.

The first end of the tubular structure is closed by a first end closure panel 222*a*, a second end closure panel 224*a*, a third end closure panel 226*a*, a fourth end closure panel 228*a* and a fifth end closure panel 230*a*. The first end closure panel 222*a* is hinged to a first end of the first base wall panel 212 by a hinged connection such as fold line 221*a*. The second end closure panel 224*a* is hinged to a first end of the first side wall panel 214 by a hinged connection such as fold line 223*a*. The third end closure panel 226*a* is hinged to a first end of the top wall panel 216 by a hinged connection such as fold line 225*a*. The fourth end closure panel 228*a* is hinged to a first end of the second side wall panel 218 by a hinged connection such as fold line 227*a*. The fifth end closure panel 230*a* is hinged to a first end of the second base wall panel 220 by a hinged connection such as fold line 229*a*.

The second end of the tubular structure is closed by a sixth end closure panel 222*b*, a seventh end closure panel 224*b*, an eighth end closure panel 226*b*, a ninth end closure panel 228*b* and a tenth end closure panel 230*b*. The sixth end closure panel 222*b* is hinged to a second end of the first base wall panel 212 by a hinged connection such as fold line 221*b*. The seventh end closure panel 224*b* is hinged to a second end of the first side wall panel 214 by a hinged connection such as fold line 223*b*. The eighth end closure panel 226*b* is hinged to a second end of the top wall panel 216 by a hinged connection such as fold line 225*b*. The ninth end closure panel 228*b* is hinged to a second end of the second side wall panel 218 by a hinged connection such as fold line 227*b*. The tenth end closure panel 230*b* is hinged to a second end of the second base wall panel 220 by a hinged connection such as fold line 229*b*.

The first and fifth end closure panel 222*a*, 230*a* and the sixth and tenth end closure panel 222*b*, 230*b* each form a minor lower end closure panel or lower dust flap at opposing ends of the tubular structure. The third end closure panel 226*a* and the eighth end closure panel 226*b* each form a minor upper end closure panel or upper dust flap at opposing ends of the tubular structure.

The second end closure panel 224*a* and the fourth end closure panel 228*a* each form a major side end closure panel at the first end of the tubular structure. The seventh end closure panel 224*b* and the ninth end closure panel 228*b* each form a major side end closure panel at the second end of the tubular structure.

The blank 210 comprises a handle structure for forming the carrying handle, the handle structure is denoted generally by reference sign H. The handle structure is formed in part in the top wall panel 216 and in part in each of the first and second side wall panels 214, 218. The handle structure is reinforced or strengthened by a reinforcing strap S secured to the top wall panel 216; optionally to an inner surface of the top wall panel 216.

The handle structure H comprises a first handle aperture A2 and a second handle aperture A4.

The first handle aperture A2 is struck in part from the top wall panel 216 and in part from the first side wall panel 214.

The second handle aperture A4 is struck in part from the top wall panel 216 and in part from the second side wall panel 218.

The first handle aperture A2 is substantially triangular in shape and is disposed such that a first, inner, edge E1 thereof is oriented substantially parallel with the longitudinal axis of the carton. A second, outer, edge E2 substantially opposes the first edge E1 and may be substantially "V" shaped.

The second handle aperture A4 is substantially triangular in shape and is disposed such that a first, inner, edge E3 thereof is oriented substantially parallel with the longitudinal axis of the carton. A second, outer, edge E4 substantially opposes the first edge E3 and may be substantially "V" shaped.

Optionally, the first handle aperture A2 is defined at least in part by a first displaceable flap 242 struck from the top wall panel 216 and hingedly connected to the top wall panel 216 by a fold line 241. Fold line 241 may define at least in part a first or inner edge of a first handle opening formed in a top wall 216 of a carton formed from blank 210. In some embodiments, the displaceable flap 242 may be struck in part from the first side wall panel 214. The first displaceable flap 242 may form a first cushioning flap when the carrying handle is in use.

Optionally, the second handle aperture A4 is defined at least in part by a second displaceable flap 244 struck from the top wall panel 216 and hingedly connected to the top wall panel 216 by a fold line 243. Fold line 243 may define at least in part a first or inner edge of a second handle opening formed in a top wall 216 of a carton formed from blank 210. In some embodiments, the displaceable flap 244 may be struck in part from the second side wall panel 218. The second displaceable flap 244 may form a second cushioning flap when the carrying handle is in use.

The first and second handle apertures A2, A4 are spaced apart from each other and define a handle strap or grip portion therebetween. The handle strap is orientated so as to extend in a direction parallel to the longitudinal or tubular axis of the carton when in a set-up condition.

The handle structure is reinforced by the reinforcing strap S secured to the top wall panel 216; optionally to the inner surface of the top wall panel 216. The reinforcing strap Sin the illustrated embodiment is substantially "bow-tie" or "I" shaped, that is to say, the reinforcing strap S is wider at each of its ends than at the middle.

In the illustrated embodiment, the reinforcing strap S is shorter in length than the top panel 216 but longer than the longitudinal dimension of the first and second apertures A2, A4. In other embodiments, the reinforcing strap S may be dimensioned so as to extend fully across the top wall panel 216 and may overlie one or both of the third and eighth end closure panels 226*a*, 226*b*.

The reinforcing strap S has the effect of reinforcing the first, inner, edge E1 of the first handle aperture A2 and the first, inner, edge E3 of the second handle aperture A4. In this way, the first and second handle openings in the top wall 216 of the carton are reinforced, two-ply construction, along each of the inner edges E1, E3.

The outer edges E2, E4 of the first and second handle openings in the top wall 216 of the carton are single ply in construction.

Figure 5A:
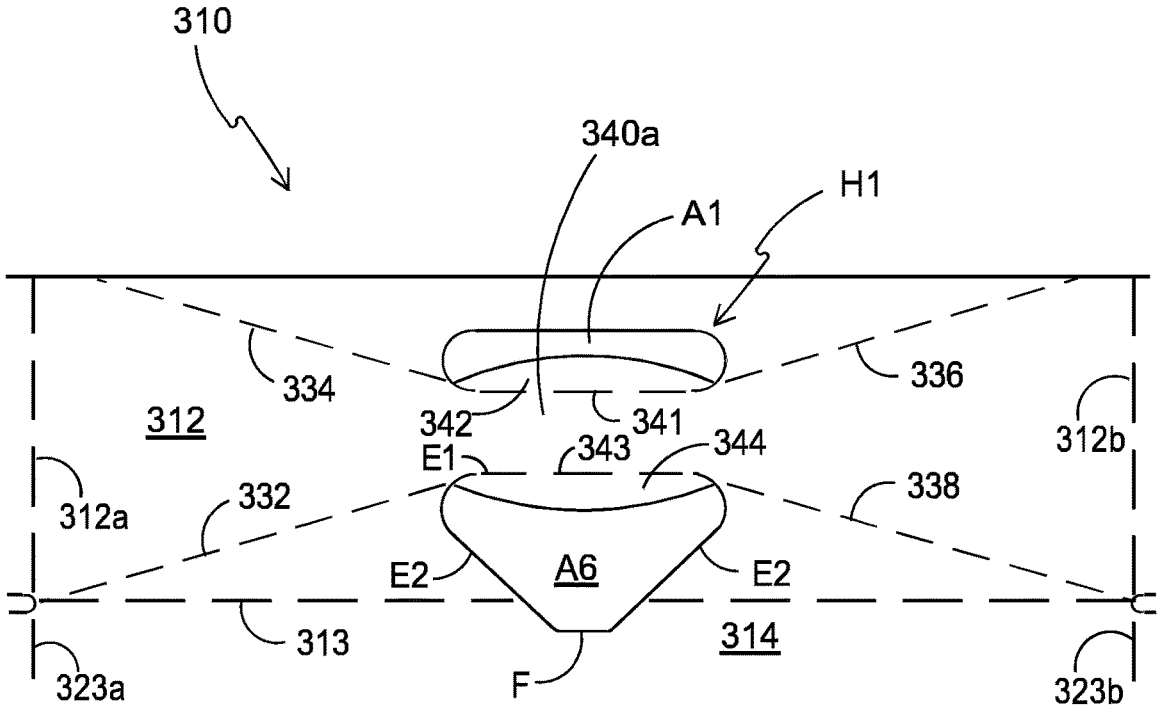
FIG. 5A is partial view of a blank for forming a carton according to a fourth embodiment of the invention.

Referring now to FIG. 5A, there is shown a plan view of a portion of a blank 310 for forming a carton, the blank 310 comprises a plurality of main panels, hinged one to the next in a linear series. FIG. 5A shows a first top wall panel 312 is hinged to a first side wall panel 314 by a hinged connection such as a fold line 313. The blank 310 also comprises a base wall panel (not shown), a second side wall panel (not shown) and a second top wall panel (not shown) arranged in a similar manner to the blank 10 of FIG. 1.

In the embodiment shown in FIG. 5A the blank 310 comprises a handle structure for forming a carrying handle. The first top wall panel 312 comprises a first part H1 of the handle structure. The second top wall panel (not shown) comprises a second part (not shown) of the handle structure. The second part of the handle structure reinforces or strengthens the first part H1 of the handle structure provided by the first top wall panel 312.

The first part H1 of the handle structure comprises a first handle cutaway and a second handle cutaway. The first handle cutaway is formed, at least in part, by a first aperture A1. The first aperture A1 is struck from the first top wall panel 312. The second handle cutaway is formed, at least in part, by a second aperture A6. The second aperture A6 is struck in part from the first top wall panel 312 and in part from the first side wall panel 314.

The first handle cutaway is elongate in shape and is similarly arranged to the first handle cutaway of the blank 10 shown in FIG. 1.

The second handle cutaway is substantially trapezoidal in shape (the second handle cutaway may substantially take the form of an acute trapezoid or an isosceles trapezoid) and is disposed such that a first, inner, edge E1 thereof is oriented substantially parallel with the longitudinal axis of the carton. A second, outer, edge comprises a pair of linear portions E2, convergently arranged with respect to each other, and a further linear portion F extending between outer ends of the pair of linear portions E2; the further linear portion F substantially opposes the first edge E1 and may be substantially parallel therewith. In other embodiments, the converging edge portions E2 may be, non-linear, curved or arcuate in shape, in a similar manner to the outer edge E2 of the second aperture A2 of the embodiment of FIG. 1.

The first and second handle cutaways are spaced apart from each other and define a handle strap 340*a* therebetween. The handle strap 340*a* is orientated so as to extend in a direction parallel to the longitudinal or tubular axis of the carton when in a set-up condition.

Optionally, the first handle cutaway is defined at least in part by a first displaceable flap 342 struck from the first top wall panel 312 and hingedly connected to the first top wall panel 312 by a fold line 341. Fold line 341 may define at least in part a first or inner edge of a first handle opening formed in a composite top wall formed in part from the first top wall panel 312. The first displaceable flap 342 may form a first cushioning flap when the carrying handle is in use.

Optionally, the second handle cutaway is defined at least in part by a second displaceable flap 344 struck from the first top wall panel 312 and hingedly connected to the first top wall panel 312 by a fold line 343. Fold line 343 may define at least in part the first or inner edge E1 of a second handle opening formed in the composite top wall of the carton. In some embodiments, the displaceable flap 344 may be struck in part from the first side wall panel 314. The second displaceable flap 344 may form a second cushioning flap when the carrying handle is in use.

The second part of the handle structure (not shown) comprises an arrangement of apertures substantially similar to that of the first part of the handle structure, albeit without the cushioning flaps, and includes an elongate aperture and a trapezoidal aperture.

Optionally, the blank 310 comprises a plurality of fold lines 332, 334, 336, 338 which form part of the handle structure. Each fold line 332, 334, 336, 338 predefines preferred locations at which the first top wall panel 312 folds when the carrying handle is employed.

Figure 5B:
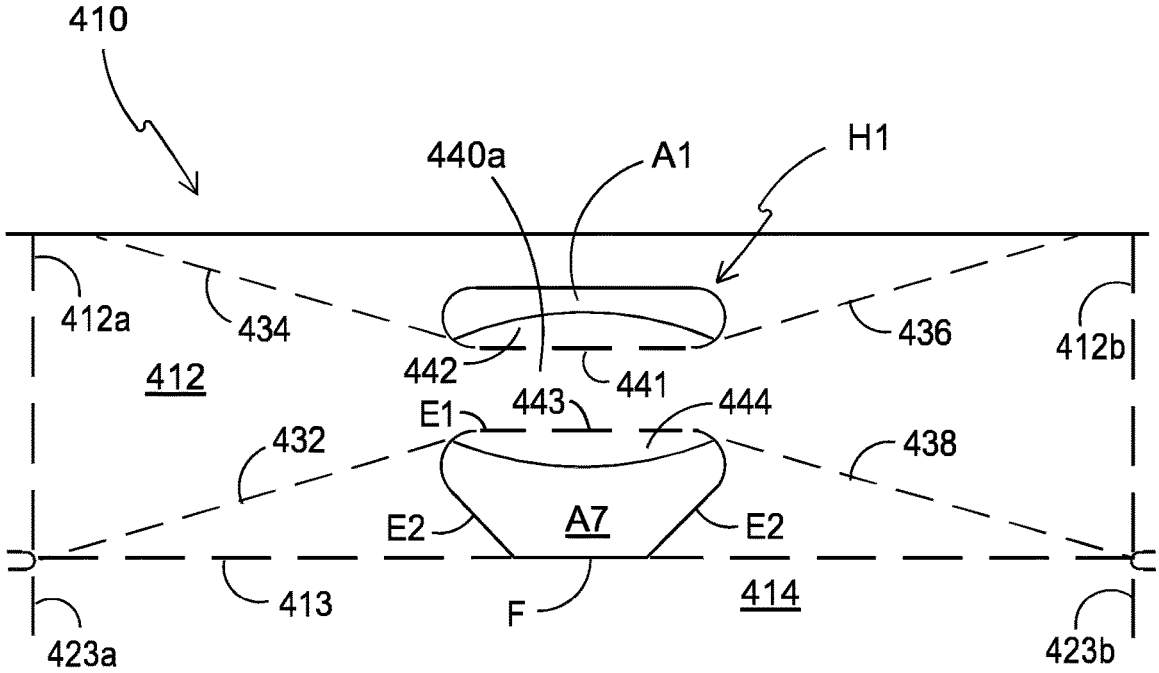
FIG. 5B is partial view of a blank for forming a carton according to a fifth embodiment of the invention.

Referring now to FIG. 5B, there is shown a plan view of a portion of a blank 410 for forming a carton, the blank 410 comprises a plurality of main panels, hinged one to the next in a linear series. FIG. 5B shows a first top wall panel 412 is hinged to a first side wall panel 414 by a hinged connection such as a fold line 413. The blank 410 also comprises a base wall panel (not shown), a second side wall panel (not shown) and a second top wall panel (not shown) arranged in a similar manner to the blank 10 of FIG. 1.

The blank 410 comprises a handle structure for forming a carrying handle. The first top wall panel 412 comprises a first part H1 of the handle structure. The second top wall panel (not shown) comprises a second part (not shown) of the handle structure. The second part of the handle structure reinforces or strengthens the first part H1 of the handle structure provided by the first top wall panel 412.

The first part H1 of the handle structure comprises a first handle cutaway and a second handle cutaway. The first handle cutaway is formed, at least in part, by a first aperture A1. The first aperture A1 is struck from the first top wall panel 412. The second handle cutaway is formed, at least in part, by a second aperture A6. The second aperture A6 is struck from the first top wall panel 412 and terminates at a side edge of the first top wall panel 412 and may interrupt fold line 413. The second aperture A6 shown in FIG. 5B is truncated or shortened when compared to the second aperture A6 shown in FIG. 5A.

The first handle cutaway is elongate in shape and is similarly arranged to the first handle cutaway of the blank 10 shown in FIG. 1.

The second handle cutaway is substantially trapezoidal in shape (the second handle cutaway may substantially take the form of an acute trapezoid or an isosceles trapezoid) and is disposed such that a first, inner, edge E1 thereof is oriented substantially parallel with the longitudinal axis of the carton. A second, outer, edge comprises a pair of linear or straight portions E2, convergently arranged with respect to each other, and a further linear portion F extending between outer ends of the pair of linear portions E2; the further linear portion F substantially opposes the first edge E1 and may be substantially parallel therewith. The further linear portion F of the embodiment shown in FIG. 5B is longer than the further linear portion F of the embodiment shown in FIG. 5A. In other embodiments, the converging edge portions E2 may be, non-linear, curved or arcuate in shape, in a similar manner to the outer edge E2 of the second aperture A2 of the embodiment of FIG. 1.

The first and second handle cutaways are spaced apart from each other and define a handle strap 440*a* therebetween. The handle strap 440*a* is orientated so as to extend in a direction parallel to the longitudinal or tubular axis of the carton when in a set-up condition.

Optionally, the first handle cutaway is defined at least in part by a first displaceable flap 442 struck from the first top wall panel 412 and hingedly connected to the first top wall panel 412 by a fold line 441. Fold line 441 may define at least in part a first or inner edge of a first handle opening formed in a composite top wall formed in part from the first top wall panel 412. The first displaceable flap 442 may form a first cushioning flap when the carrying handle is in use.

Optionally, the second handle cutaway is defined at least in part by a second displaceable flap 444 struck from the first top wall panel 412 and hingedly connected to the first top wall panel 412 by a fold line 443. Fold line 443 may define at least in part the first or inner edge E1 of a second handle opening formed in the composite top wall of the carton. The second displaceable flap 444 may form a second cushioning flap when the carrying handle is in use.

Optionally, the blank 410 comprises a plurality of fold lines 432, 434, 436, 438 which form part of the handle structure. Each fold line 432, 434, 436, 438 predefines preferred locations at which the first top wall panel 412 folds when the carrying handle is employed.

It can be appreciated that various changes may be made within the scope of the present invention. For example, the size and shape of the panels and apertures may be adjusted to accommodate articles of differing size or shape.

Whilst the foregoing embodiments have been described with reference to a fully enclosed carton it is envisaged that the dispenser may be employed in cartons of alternative design such as, but not limited to, wraparound style cartons, basket carries and top gripping clips.

It will be recognized that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed, it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and apertures may be adjusted to accommodate articles of differing size or shape.

As used herein, the term "cutaway" may refer to one of the following: a recess, a notch, a slot, an opening, a outline, a line of perforations, a line of short slits, a line of half-cuts, a single half-cut, an interrupted cut line, aligned slits, a line of short scores and any combination of the aforesaid options, without departing from the scope of the invention.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed, a hinged connection can be formed from one or more fold lines. A hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. Atypical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the term "severance line" may refer to all manner of lines formed in the blank or substrate of sheet material that facilitate separating portions of the blank or substrate of sheet material from one another, or otherwise that indicate optimal separation locations on the blank or substrate. As used herein, the term "severance line" may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines and severance lines can each include elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a frangible fold line, or to facilitate breaking with little effort to provide a severance line.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for packaging one or more articles, the carton comprising:

a first panel;

a second panel connected to the first panel by a hinged connection; and a handle structure comprising:

a handle aperture struck from the first panel and defining in part a carrying handle, the handle aperture comprising;

a first edge defining in part a grip portion of the carrying handle and providing a load-bearing edge; and a second edge opposing the first edge, the second edge being a non-load-bearing edge;

wherein the handle structure comprises a reinforcing member which reinforces the load-bearing edge, and wherein the second edge of the handle aperture extends across the first panel to interrupt the hinged connection between the first and second panels.

2. The carton according to claim 1, wherein the first panel and the reinforcing member define a multi-layer structure along the first edge.

3. The carton according to claim 1, wherein the second edge is an unreinforced structure.

4. The carton according to claim 3, wherein the second edge is a single-layer structure.

5. The carton according to claim 1, comprising a second handle aperture struck from the first panel and defining in part the carrying handle, the second handle aperture comprising;

a third edge defining in part the grip portion of the carrying handle and providing a second load-bearing edge; and a fourth edge opposing the third edge, the fourth edge being a non-load-bearing edge;

wherein the reinforcing member reinforces the second load-bearing edge.

6. The carton according to claim 5, wherein the fourth edge of the second handle aperture extends across the first panel to interrupt a second hinged connection between the first panel and a third panel.

7. The carton according to claim 1, comprising a third panel secured in at least partial overlapping relationship with the first panel to form a composite wall panel of the carton, and a fourth panel connected to the third panel by a hinged connection, the third panel comprising a second handle aperture struck therefrom and defining in part the reinforcing member, the second handle aperture comprising;

a third edge defining in part a grip portion of the carrying handle and providing a second load-bearing edge; and a fourth edge opposing the third edge, the fourth edge being a non-load-bearing edge;

wherein the second edge of the second handle aperture extends across the third panel to interrupt the hinged connection between the third panel and the fourth panel.

8. The carton according to claim 1, wherein the handle aperture is shaped such that the second edge is disposed in close proximity to one or more of the one or more articles disposed within the carton in a packaged state, so as to inhibit a user from engaging with the second edge in the packaged state.

9. A blank for forming a carton, the blank comprising a plurality of panels for forming a tubular structure including a top wall panel and first side wall panel hinged to the top wall panel by a first hinged connection, the blank comprising a handle structure comprising:

a handle aperture struck at least in part from the top wall panel and defining in part a handle strap, the handle aperture comprising;

a first edge defining in part a grip portion of the handle strap and providing a load-bearing edge; and a second edge opposing the first edge, the second edge being a non-load-bearing edge;

a reinforcing member securable to the top wall panel to reinforce the load-bearing edge of the handle aperture, and wherein the handle aperture extends across the first panel such that the second edge interrupts the hinged connection between the top wall panel and first side wall panel.

10. The blank according to claim 9 comprising a second side wall panel hinged to the top wall panel by a second hinged connection wherein the handle structure comprises:

a second handle aperture struck at least in part from the top wall panel and defining in part the handle strap, the second handle aperture comprising;

a third edge defining in part a grip portion of the handle strap and providing a second load-bearing edge; and a fourth edge opposing the third edge, the fourth edge being a second non-load-bearing edge;

wherein the reinforcing member reinforces the second load-bearing edge, and wherein the second handle aperture extends across the top panel such that the second edge interrupts the hinged connection between the top wall panel and the second side wall panel.

11. The blank according to claim 9 comprising a second side wall panel hinged to a second top wall panel by a second hinged connection wherein the handle structure comprises:

a second handle aperture struck at least in part from the second top wall panel, the second handle aperture comprising;

a third edge providing a second load-bearing edge; and a fourth edge opposing the third edge, the fourth edge being a second non-load-bearing edge;

wherein the second top wall panel comprises the reinforcing member which reinforces the first and second load-bearing edge in a setup carton, and wherein the second handle aperture extends across the second top panel such that the fourth edge interrupts the hinged connection between the second top wall panel and the second side wall panel.

12. The blank according to claim 9, wherein the first panel and the reinforcing member are configured to define a multi-layer structure along the first edge in the carton form.

13. The blank according to claim 9, wherein the second edge is an unreinforced, single-layer structure.

14. A blank for forming a carton, the blank comprising a plurality of panels including a top panel, a first side wall panel, and a second side wall panel, the blank comprising a handle structure defined at least in the top panel, the handle structure comprising a grip portion, wherein the blank comprises a relief structure for controlling and directing deformation of at least one of the first and second side wall panels, the relief structure comprising a first fold line extending across at least a portion of said at least one of the first and second side wall panels, and a pair of divergently arranged fold lines disposed on opposing sides of the first fold line, wherein a handle aperture interrupts a hinged connection between the top panel and said at least one of the first and second side wall panels, the handle aperture interrupts the hinged connection adjacent to the relief structure.

15. The blank according to claim 14, wherein the handle aperture is struck at least in part from the top panel, the handle aperture comprising:

a first edge defining in part the grip portion of the handle structure and providing a load-bearing edge; and a second edge opposing the first edge, the second edge being a non-load-bearing edge.

16. The blank according to claim 15, comprising a reinforcing member securable to the top panel to reinforce the load-bearing edge of the handle aperture.

17. The blank according to claim 15, comprising an additional handle aperture, the additional handle aperture comprising:

a third edge providing an additional load-bearing edge; and a fourth edge opposing the third edge, the fourth edge being an additional non-load-bearing edge.

* * * * *